US008505122B1

(12) United States Patent
Green et al.

(10) Patent No.: US 8,505,122 B1
(45) Date of Patent: Aug. 13, 2013

(54) SPORTS IMPACT PROTECTION SYSTEM

(76) Inventors: Michael S. Green, East Brunswick, NJ (US); Cliff L. Zatz, East Brunswick, NJ (US)

( * ) Notice: Subject to any disclaimer, the term of this patent is extended or adjusted under 35 U.S.C. 154(b) by 0 days.

(21) Appl. No.: 13/271,011

(22) Filed: Oct. 11, 2011

Related U.S. Application Data

(60) Provisional application No. 61/392,012, filed on Oct. 11, 2010.

(51) Int. Cl.
*A41D 13/00* (2006.01)

(52) U.S. Cl.
USPC ..... 2/463

(58) Field of Classification Search
USPC ..... 2/463, 464, 69, 94, 455, 2.5, 108, 2/247
See application file for complete search history.

(56) References Cited

U.S. PATENT DOCUMENTS

D632,845 S 2/2011 Green et al.
D632,846 S 2/2011 Green et al.

*Primary Examiner* — Tejash Patel
(74) *Attorney, Agent, or Firm* — Paul Diamond, Esq.; Diamond Law Office LLC

(57) ABSTRACT

The invention provides a sports impact protection system adaptable for use with ordinary sports apparel such shirts, pants and shorts. The system includes one or more impact absorbing pads and means for reversibly attaching the pads to sports apparel.

18 Claims, 6 Drawing Sheets

SPORTS IMPACT PROTECTION SYSTEM

CROSS-REFERENCE TO RELATED APPLICATIONS

This application claims the benefit of U.S. provisional application Ser. No. 61/392,012 filed Oct. 11, 2010, which is incorporated by reference herein in its entirety.

FIELD OF THE INVENTION

The invention relates to the field of impact-absorbing sports accessories.

BACKGROUND OF INVENTION

Projectile-based sports such as baseball, softball and lacrosse present particular risks of injury from projectile strikes to players' bodies. What is needed are improved yet practical impact protection systems.

SUMMARY OF INVENTION

One embodiment of the invention provides an apparel-attachable impact protection kit that includes:

at least one discrete, impact-absorbing protective pad, said pad having a thickness and an expansive dimension, a front side and a back side;

a first at least one strip or sheet having two sides, a reversible touch fastener, such as a hook and loop-type fastener such as Velcro™, on one side and the other side being attached to or irreversibly attachable to the back of the pad;

a second at least one strip or sheet having two sides, a reversible touch fastener such as a hook and loop fastener such as Velcro on one side reversibly attachable (mateable) with the touch fastener side of the first at least one strip or sheet, and the other side irreversibly attachable to a fabric apparel item.

The side of the second at least one strip or sheet irreversibly attachable to the fabric apparel item may be self-adhesive such that a user may attach it to an apparel article such as a shirt. The side of the second at least one strip or sheet irreversibly attachable to the fabric apparel item may, for example, include heat-activated adhesive, for example, iron-on adhesive. In a further variation, the other side of the first at least one strip or sheet is self-adhesive, whereby the at least one strip or sheet is irreversibly attachable to the back of the pad, e.g., by peeling off a peelable sheet from the self-adhesive side to expose the adhesive and pressing that side to the apparel item to adhere it thereon.

The protective pad(s) may be made, in whole or part, of any shock-absorbing material. For example, the pads may be or be made with a closed cell rubberized gel foam form. (Gel Tec Industry Ltd, Taiwan, R.O.C.) The form may be covered in fabric. The pad may include or consist essentially of a base portion at least substantially coextensive with the expansive dimension of the pad and a plurality of pods protruding from the base portion, said pods laterally spaced apart from one another. The lateral spacing of the pods imparts flexibility to the protective pad, which is especially important when the pads are worn on form-fitting garments. The base and the pods may be part of the same unitary form.

The at least one protective pad of the kit may include a protective chest pad, sized and configured to at least partially cover the portion of a person's chest in which the heart is disposed. In one variation, the chest pad has a top and bottom together defining a vertical height, and horizontal width, the width of the chest pad tapering in one or more steps toward the bottom, and further comprises: a laterally centrally disposed vertical pod; and to each lateral side of the vertical pod, a set of vertically arranged pods. The laterally centrally disposed vertical pod may extend at least substantially from the top to the bottom of the chest pad, with the proviso that a margin between the edge of the chest pad defined by the perimeter of the base of the pad and adjacent pods may be present. The chest pad may, for example, be bilaterally symmetric or bilaterally asymmetric.

The kit may also include at least one template sized and configured for attaching the second at least one strip or sheet to the fabric apparel item in a predetermined location and/or configuration to a subject apparel and/or sized and configured to cut larger lengths of Velcro strips or sheets to their size(s) for use with the pad(s) of the kit. The template may, for example, be made of paper or cardboard.

The kit may also include at least one apparel item selected from the group consisting of a shirt, long pants, shorts (short pants), hosiery such as but not limited to socks, under garments such as but not limited to briefs, a hat such as a baseball cap, e.g., a conventional fabric baseball cap, and a helmet or any combination thereof.

Related embodiments of the invention provide kits that include the fabric apparel item with the second at least one strip or sheet already irreversibly attached thereto, for example, by adhesive and/or stitched (sewn) thereto. For example, one embodiment of the invention includes:

at least one discrete, impact-absorbing protective pad, said pad having a thickness, an expansive dimension, a front side and a back side;

a first at least one strip or sheet having two sides, a reversible touch fastener such as a hook and loop fastener such as Velcro disposed on one side and the other side being attached to the back of the pad;

a second at least one strip or sheet having two sides, a touch fastener (such as hook and loop fastener such as Velcro) disposed on one side and reversibly attachable to the touch fastener side of the first at least one strip or sheet, and the other side irreversibly attached to a fabric apparel item, such as but not limited to a shirt, long pants, shorts (short pants), socks, a hat and an under garment.

Further related embodiments of the invention provide the functional assemblages of the components of the aforementioned kit embodiments and any of their variations. For example, one embodiment of the invention includes:

at least one discrete, impact-absorbing protective pad, said pad having a thickness, an expansive dimension, a front and a back;

a first at least one strip or sheet having two sides, a reversible touch fastener (such as hook and loop fastener such as Velcro) disposed on one side and the other side being attached to the back of the pad;

a second at least one strip or sheet having two sides, a reversible touch fastener (such as hook and loop fastener such as Velcro) disposed on one side reversibly attachable to the touch fastener side of the first at least one strip or sheet, and the other side irreversibly attached to a fabric apparel item, such as but not limited to a shirt, long pants, shorts (short pants), socks, a hat and an under garment.

wherein the protective pad is reversibly attached to the fabric apparel item via touch fastener (such as hook and loop fastener such as Velcro) connection of the touch fastener side of the first at least one strip or sheet and the touch fastener (such as hook and loop fastener such as Velcro) side of the second at least one strip or sheet.

The protective articles and systems of the invention are not only employable in the context of sports but may also be used whenever protection against impacts and projectiles is desirable.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention.

DETAILED DESCRIPTION

The present invention provides kits and assemblages for impact protection of a human body that are characterized by their adaptability for use with ordinary, non-specialized apparel and by the reversible attachment of the protective pads of the kits to said apparel. The impact protection kits and assemblages of the invention are of particular utility in sports such as baseball, softball or lacrosse where the risk of projectile strikes to the body are a significant concern, but also find utility in any situation where impact protection is desirable.

The invention is further described below with reference to the appended figures.

Figure 1:
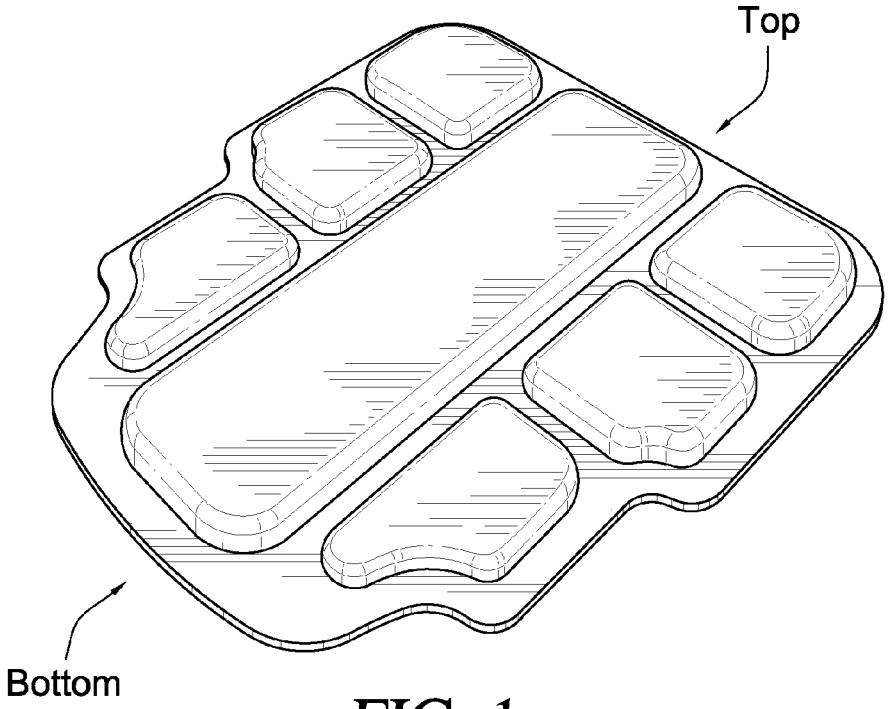
FIG. 1 shows a front perspective view of a protective chest guard embodiment of the invention.

FIG. 1 shows a perspective view of a protective chest guard embodiment of the invention, showing the front side of the protective pad and indicating the top and bottom of the pad. As shown, all of the outer perimeter corners are rounded. Also, as shown, all of the edges of the pods are rounded.

Figure 2:
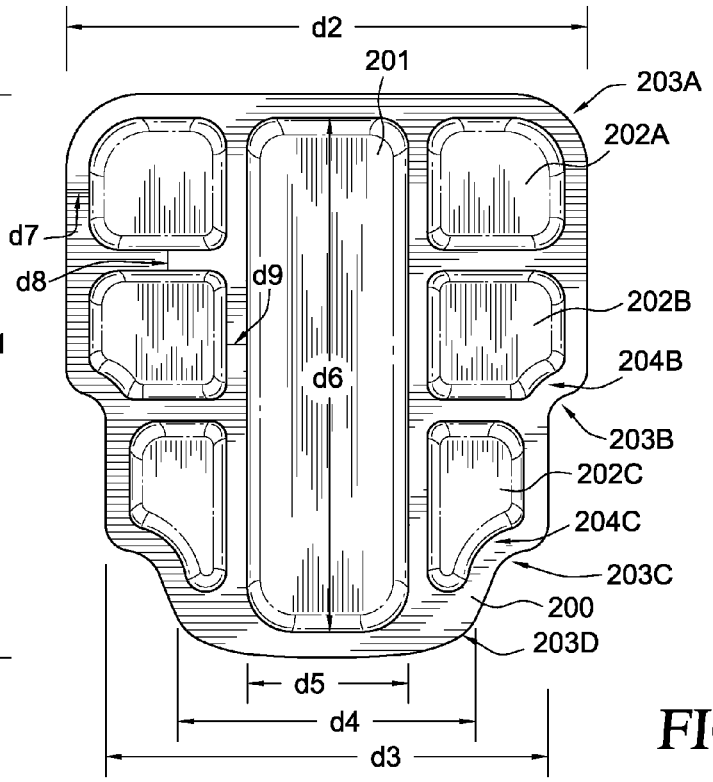
FIG. 2 shows a front view of the protective chest guard embodiment of FIG. 1.

FIG. 2 shows a front view of the protective chest guard embodiment of FIG. 1. The height d1 from top to bottom is shown and is greater than the width d2. From top to bottom the width of the protective chest pad tapers, consisting of three step portions P1 (maximum width d2), P2 (maximum width d3), and P3 (maximum width d4). A vertically oriented rectangular center pod 201 having maximum width d5 and height d6 is centrally laterally disposed. To each side of center pod 201 are three, vertically stacked pods, indicated on one side as 202A-C. The embodiment shown is bilaterally symmetric. All of the pods are spaced by a distance d7 from the outer perimeter of the pad which is defined by base portion 200. The pods are also spaced apart from one another; d8 is the distance between the adjacent vertically stacked lateral pods and d9 is the distance between center pod 201 and the neighboring lateral pods. A concave curve is present in the profile of the base portion at the junction of portions P1 and P2 and also at the junction of P2 and P3. The shape of the adjacent portions of the lateral pods, 204B and 204C respectively, mimic the concavity at said junctions. All outer corners, 203A-D of the base portion are rounded. The ratio of d1 to d2 may, for example, be 140:130 or about 140:130. In one variation d1 is 140 mm or about 140 mm and d2 is 130 mm or about 130 mm. d7 may, for example, be 4, 5, 6 or 7 mm. Each of d8 and d9 may, for example, be 4, 5, 6, or 7 mm. In a particular combination, d7 is 6 mm and each of d8 and d9 is 5 mm. d5 may, for example, be 40 mm. The maximum width of 202A and 202B may, for example, be 35 mm. The maximum width of 202C may, for example, be 24 mm or 25 mm.

Figure 3:
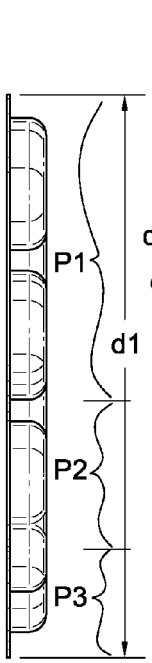
FIG. 3 shows a left-side view of the protective chest guard embodiment of FIG. 1.

FIG. 3 shows a left-side view of the protective chest guard embodiment of FIG. 1.

Figure 4:
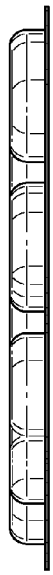
FIG. 4 shows a right-side view of the protective chest guard embodiment of FIG. 1.

FIG. 4 shows a right-side view of the protective chest guard embodiment of FIG. 1.

Figure 5:
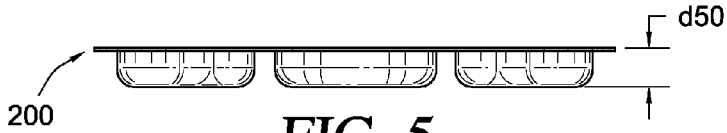
FIG. 5 shows a top view of the protective chest guard embodiment of FIG. 1.

FIG. 5 shows a top view of the protective chest guard embodiment of FIG. 1. The base portion 200 defining the expansive dimension of the protective pad is shown, as well as the thickness d50 of the thicker pod portions. The thickness of the base portion alone may, for example, be about 1 mm to about 3 mm, such as 1 mm, 2 mm or 3 mm, while the thickness of the pod portions, including depth to the back side, may, for example, be about 10 mm. The thickness of the various pod portions may all be the same or may vary.

Figure 6:
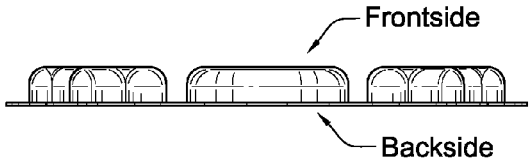
FIG. 6 shows a bottom view of the protective chest guard embodiment of FIG. 1.

FIG. 6 shows a bottom view of the protective chest guard embodiment of FIG. 1.

Figure 7:
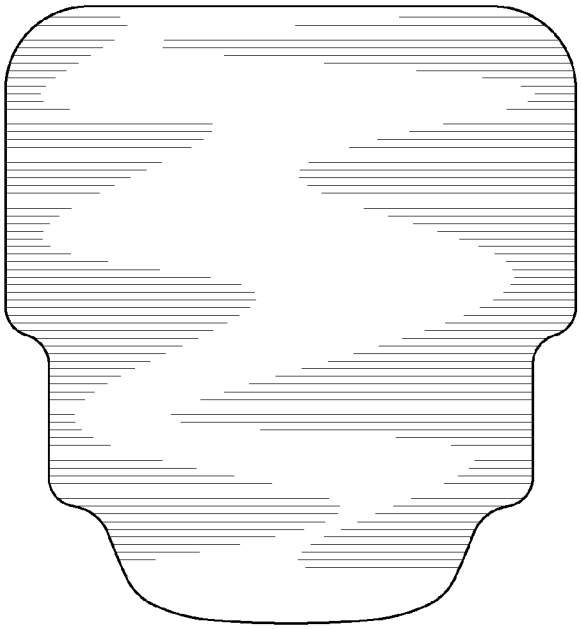
FIG. 7 shows a back-side view of the protective chest guard embodiment of FIG. 1.

FIG. 7 shows a back-side view of the protective chest guard embodiment of FIG. 1. The back side may present an at least substantially flat surface to facilitate adhesive joining of the pad to strips and/or sheets having a touch fastener such as Velcro on one side.

Figure 8:
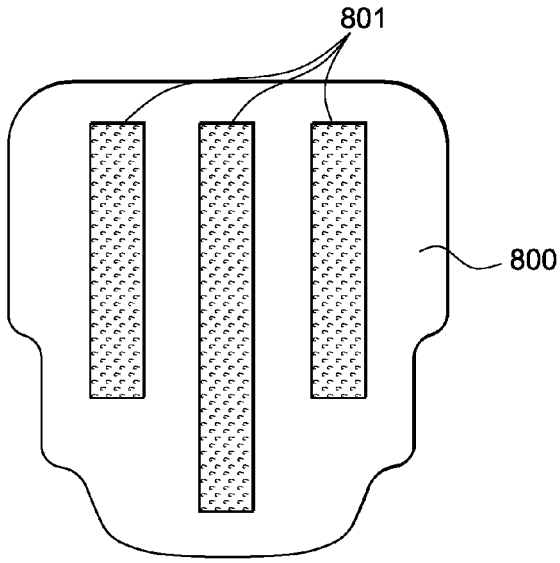
FIG. 8 shows the back-side of the protective chest guard shown in FIG. 1 with three Velcro strips attached thereto.

FIG. 8 shows the back-side 800 of the protective chest guard shown in FIG. 1 with three Velcro strips 801 attached thereto. A kit according to the invention may include one or more self-adhesive Velcro strips for attachment to the protective pad. In this case, where more than one discrete strip is recommended to be used with a pad, as shown, either pre-cut strips may be provided or an uncut strip may be provided for trimming by the purchaser or end-user. The invention also provides kits in which the Velcro strips are pre-attached to the back side of a subject protective pad of the kit.

Figure 9:
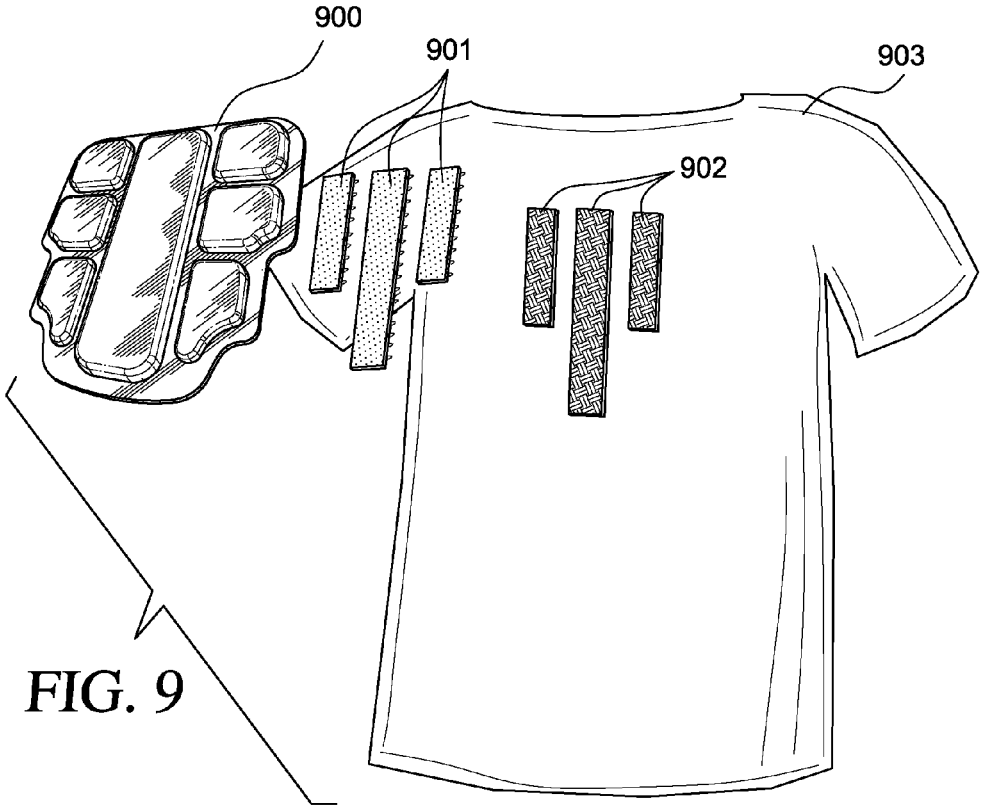
FIG. 9 is an exploded view of a protective chest guard as shown in FIG. 1, a first set of three Velcro strips which are attachable to the chestguard, a sports jersey and a second set of three Velcro strips attachable to the sports jersey.

FIG. 9 is an exploded view of a protective chest guard 900 as shown in FIG. 1, a first set of three Velcro strips 901 which are attachable to the chestguard, a sports jersey 903 and a second set of three Velcro strips 902 attachable to the sports jersey.

Figure 10:
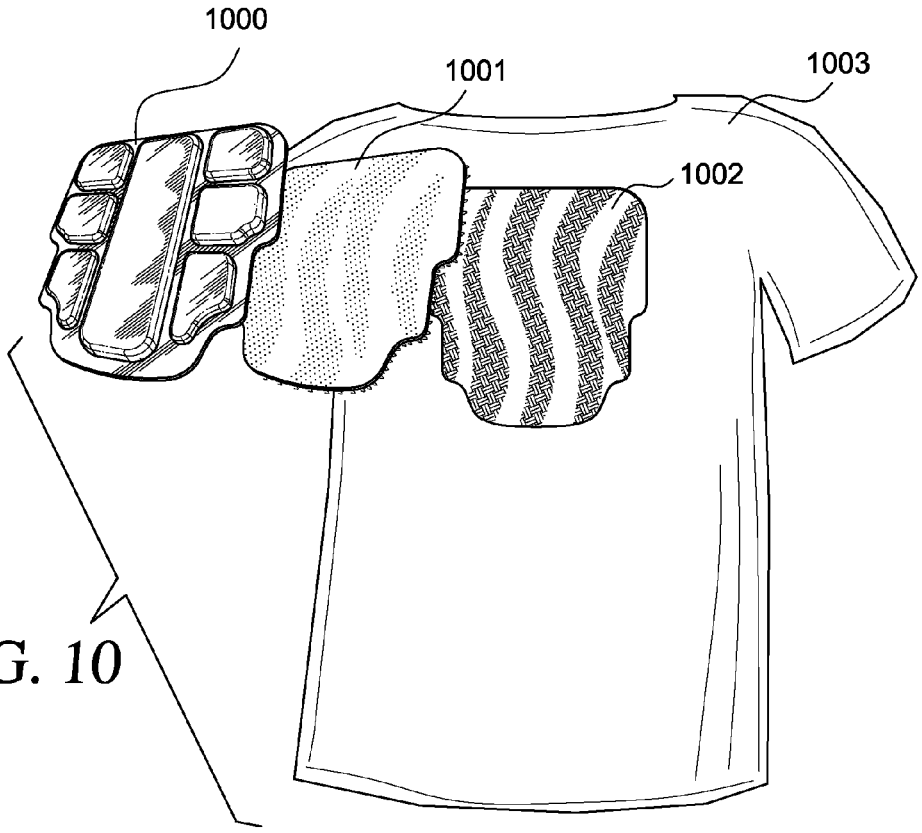
FIG. 10 is an exploded view of a protective chest guard as shown in FIG. 1, a first custom Velcro sheet that mimics the profile shape of the chestguard and attaches thereto on one side with Velcro fastener exposed on the other side, a sports jersey and a second custom Velcro sheet that mimics the profile shape of the chestguard and is irreversibly attachable to the sports jersey on one side with the other side exposing Velcro fastener mate-able (attachably engageable) with the exposed Velcro fastener of the first sheet.

FIG. 10 is an exploded view of a protective chest guard 1000 as shown in FIG. 1, a first custom Velcro sheet 1001 that mimics the profile shape of the chestguard and attaches thereto on one side with Velcro fastener exposed on the other side, a sports jersey 1003 and a second custom Velcro sheet 1002 that mimics the profile shape of the chestguard and is irreversibly attachable to the sports jersey on one side with the other side exposing Velcro fastener mate-able (fastenably engageable) with the exposed Velcro fastener of the first sheet.

Figure 11:
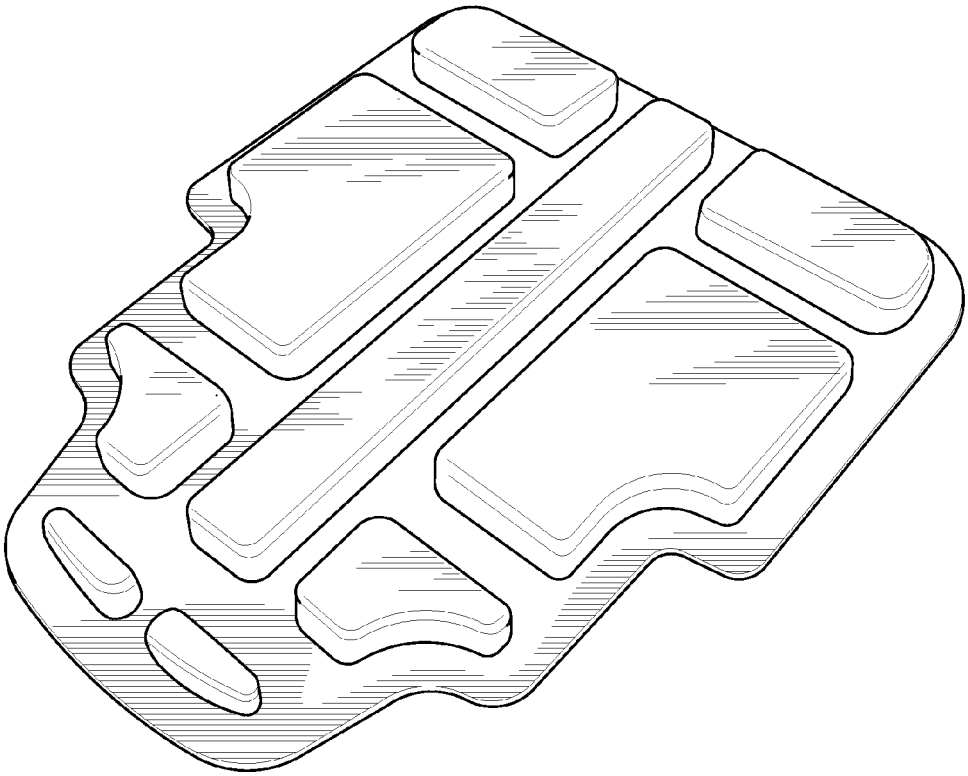
FIG. 11 shows a different chest guard embodiment of the embodiment.

FIG. 11 shows a chest guard embodiment of the invention having a partially different layout as that shown in FIG. 1, but which is also bilaterally symmetric. The ratio of the overall height to the maximum width of this embodiment may be 180:145 or about 180:145. For example, the height may be 180 mm and the maximum width may be 145 mm. Two additional pods are disposed at the bottom of this embodiment compared to the embodiment shown in FIG. 1.

Figure 12:
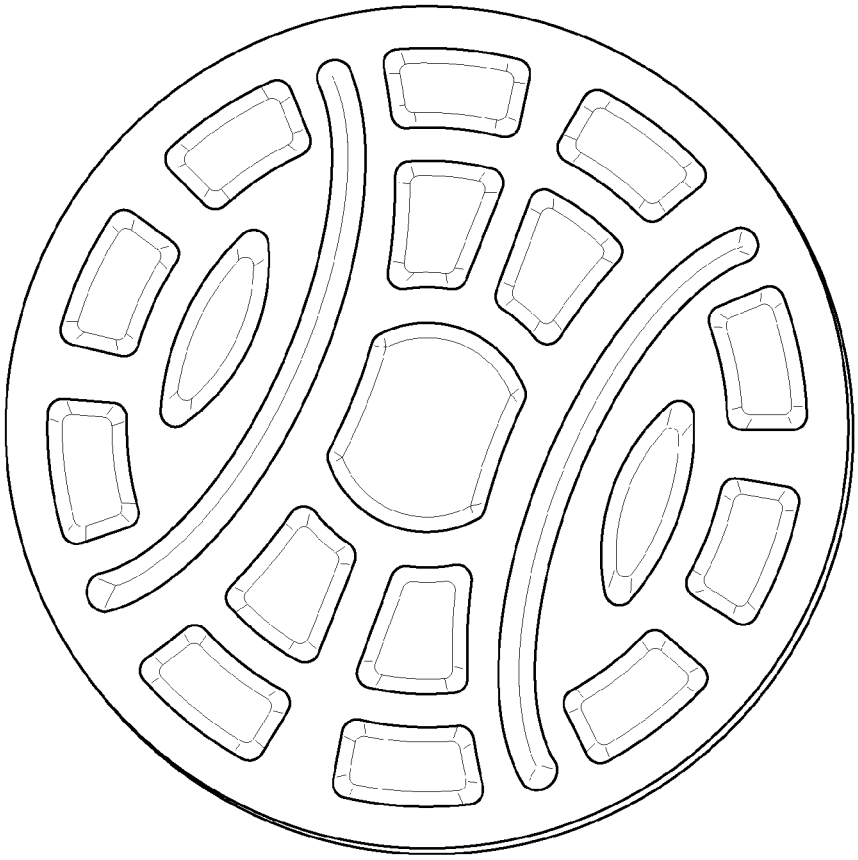
FIG. 12 shows a protective body guard embodiment of the invention that has a circular profile and mimics the appearance of a baseball.

The invention has been illustrated with respect to a protective, impact-absorbing chest pad having a specific configuration. However, the protective pads of the invention may take any profile shape. For example, a protective pad for use in the invention may be, or generally be, rectangular, square, rhomboidal, triangular, circular, oval, trapezoidal, cross-shaped, aster-shaped, crescent-shaped, serpentine ribbon, irregularly shaped or any combination thereof. FIG. 12 shows a front view of one embodiment of a protective sports guard of the invention that has a circular outer profile and a number of differently shaped pods protruding from the circular base of the guard. Among the pods in this embodiment are two narrow extended pods disposed in manner to resemble the stitching pattern of baseball. A circular sports guard pad as the one shown in FIG. 12 may for example have any desired diameter, such as a diameter of 3-8 inches, such as in the range 2-3 inches, 3-4 inches, 4-5 inches, 5-6 inches, 6-7 inches or 7-8 inches.

The invention also provides both pads which are continuous, i.e., which do not include holes, as shown in the figures or those having one or more holes or openings continuing from the front side to the back side of the pad. The hole(s)s or opening(s), when present, may be through the pod portion(s) and/or the base-only portion(s) of a pad. Pads having such holes or openings may be provided to increase ventilation and comfort when desired, such as in hot weather.

The assemblages of the invention may be configured so that the protective pads are attached to the outside of an apparel item, e.g., the exterior side of a shirt, or to the interior side of the apparel item. The protection afforded by the pads is provided in both cases. Advantageously, the invention permits a sports player or other user to custom design the impact protection provided by selecting one or more various protective pads and disposing them at desired locations on their apparel so that underlying parts of the body are protected from impacts while the apparel is worn with the pads attached.

In any embodiment or variation thereof, the first sheet with touch fastener such as Velcro on one side and the second sheet with touch fastener such as Velcro on one side may each be shaped to mimic the shape of the protective pad with which they are used. Thus, a kit of the invention may include for each protective pad therein, a first sheet with touch fastener on one side, the opposite side attached to or attachable to the back side of the pad, being in or approximating the shape of the pad with which it is used, and a corresponding second sheet with touch fastener (capable of attachably engaging the touch fastener of the first sheet) on one side, the opposite side attachable to or attached to an apparel item, also being in or approximating the shape of the protective pad with which it is used. In one variation, where the sheets mimic the shape of the pads with which they are used, the sheets are slightly smaller than the outer dimension defined by the perimeter of the pads.

Fabric apparel item has a broad meaning herein and including without limitation apparel made of natural and/or synthetic fabric(s)s and apparel materials, and apparel items made of woven and/or non-woven fabric(s). Without limitation, examples of fabrics with which the invention can be used are cotton, wool, polyester, microfiber, rayon and nylon and any blend or combination thereof.

The invention also provides a detachable supplemental impact protection system and related kits for providing supplemental impact protection to impact protection headwear including but not limited to a hard impact-protective helmet such as a bike helmet, baseball/softball batting helmet, lacrosse helmet, and other padded headgear such as boxing headgear and the like. In this case, the components of the kit are assembled to dispose the detachable pads to the outside of the headgear.

Although various embodiments of the invention have been exemplified with hook-and-loop type touch fasteners, any type of reversible touch fastener such as those known in the art may be used according to the invention. By reversible touch fasteners what is meant is that engaged touch fastener surfaces can be separated by the user and then reengaged as desired. Velcro hook and loop-type fasteners may, for example, be used with the present invention as described, including for example, adhesive backed Velcro tape (Sticky-Back®, e.g., hook, for use on the protective pads) and heat-activated, "iron-on" Velcro tape (FabricFusion®, e.g., loop, for adhesion to the apparel item). (Velcro USA Inc., Manchester, N.H.) Instead of hook and loop type fasteners, self engageable fastener (Velcro USA Inc., Manchester, N.H.) may, for example, also be used.

By irreversibly attached, what is meant herein in connection with the direct attachment to an apparel item of the sheet or strips (that present a touch fastener surface to reversibly attach a protective guard to the apparel item) is either permanent under normal conditions for the life of the apparel item, such as sewn on or adhered with a strong long-lasting adhesive, or is at least sufficiently durable to last through at least a few clothes washings. By irreversibly attached, what is meant herein in connection with the direct attachment of the strip or sheets to the protective pads of the invention is that the strips or sheets durably remain attached to the pad for at least a few cycles of reversibly detaching the pads from an apparel item and reattaching the pad to an apparel item under normal conditions. The direct attachment of the touch fastener-presenting strips or sheets to the protective pads of the invention may, for example, be permanent or long-lasting.

Each of the patents and other publications cited in this disclosure is incorporated by reference in its entirety.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

What is claimed is:

1. An apparel-attachable impact protection kit, comprising:

at least one discrete, impact-absorbing protective pad, said pad having a thickness an expansive dimension, a front and a back;

a first at least one strip or sheet having two sides, a reversible touch fastener disposed on one side and the other side being attached to or irreversibly attachable to the back of the pad;

a second at least one strip or sheet having two sides, a reversible touch fastener disposed on one side reversibly attachable to the touch fastener side of the first at least one strip or sheet, and the other side irreversibly attachable to a fabric apparel item, wherein said pad consists essentially of a base portion at least substantially coextensive with the expansive dimension of the pad and a plurality of pods protruding from the base portion, said pods laterally spaced apart from one another, wherein the base portion and the pods are part of the same unitary form, and wherein said pad is optionally covered in fabric.

2. The kit of claim 1, wherein the side of the second at least one strip or sheet irreversibly attachable to the fabric apparel item is self-adhesive.

3. The kit of claim 1, wherein the side of the second at least one strip or sheet irreversibly attachable to the fabric apparel item comprises heat-activated adhesive.

4. The kit of claim 1, wherein the other side of the first at least one strip or sheet is self-adhesive, whereby the at least one strip or sheet is irreversibly attachable to the back of the pad.

5. The kit of claim 2, wherein the other side of the first at least one strip or sheet is self-adhesive, whereby the at least one strip or sheet is irreversibly attachable to the back of the pad.

6. The kit of claim 3, wherein the other side of the first at least one strip or sheet is self-adhesive, whereby the at least one strip or sheet is irreversibly attachable to the back of the pad.

7. The kit of claim 1, wherein the pad is comprised a rubberized gel foam form.

8. The kit of claim 7, wherein the rubberized gel foam form is covered in fabric.

9. The kit of claim 1, wherein the at least one protective pad comprises a protective chest pad sized and configured to at least partially cover the portion of a person's chest in which the heart is disposed.

10. The kit of claim 9, wherein the chest pad has a top and bottom together defining a vertical height, and horizontal width, the width of the chest pad tapering in one or more steps toward the bottom, and further comprises:

a laterally centrally disposed vertical pod; and to each lateral side of the vertical pod, a set of vertically arranged pods.

11. The kit of claim 10, wherein the laterally centrally disposed vertical pod extends at least substantially from the top to the bottom of the chest pad, with the proviso that a margin between the edge of the chest pad defined by the perimeter of the base of the pad and adjacent pods may be present.

12. The kit of claim 10, wherein the chest pad is bilaterally symmetric.

13. The kit of claim 1, further comprising at least one template sized and configured for attaching the second at least one strip or sheet to the fabric apparel item in a predetermined location.

14. The kit of claim 1, further comprising at least one apparel item selected from the group consisting of a shirt, long pants, short pants, hosiery, a hat and an under garment.

15. An impact-protective sports apparel assemblage, comprising:

at least one discrete, impact-absorbing protective pad, said pad having a thickness, an expansive dimension, a front and a back;

a first at least one strip or sheet having two sides, a touch fastener disposed on one side and the other side being attached to the back of the pad;

a second at least one strip or sheet having two sides, a touch fastener disposed on one side reversibly attachable with the touch fastener side of the first at least one strip or sheet, and the other side irreversibly attached to a fabric apparel item, such as but not limited to a shirt, long pants, shorts (short pants), socks, a hat and an under garment, wherein said pad consists essentially of a base portion at least substantially coextensive with the expansive dimension of the pad and a plurality of pods protruding from the base portion, said pods laterally spaced apart from one another, wherein the base portion and the pods are part of the same unitary form, wherein said pad is optionally covered in fabric, and wherein said pad is reversibly attached to the fabric apparel item via engagement of the touch fastener side of the first at least one strip or sheet and the touch fastener side of the second at least one strip or sheet.

16. The impact-protective sports apparel assemblage claim 15, wherein the fabric apparel item is selected from the group consisting of: a shirt, long pants, short pants, hosiery, a hat and an under garment.

17. An apparel-attachable impact protection kit, comprising:

at least one discrete, impact-absorbing protective pad, said pad having a thickness, an expansive dimension, a front and a back;

a first at least one strip or sheet having two sides, a touch fastener disposed on one side and the other side being attached to the back of the pad;

a second at least one strip or sheet having two sides, a touch fastener disposed on one side reversibly attachable to the touch fastener side of the first at least one strip or sheet, and the other side irreversibly attached to a fabric apparel item, wherein said pad consists essentially of a base portion at least substantially coextensive with the expansive dimension of the pad and a plurality of pods protruding from the base portion, said pods laterally spaced apart from one another, wherein the base portion and the pods are part of the same unitary form, and wherein said pad is optionally covered in fabric.

18. The kit of claim 17, wherein the fabric apparel item is selected from the group consisting of: a shirt, long pants, short pants, hosiery, a hat and an under garment.

* * * * *